US006931754B2

(12) United States Patent
Sennhenn et al.

(10) Patent No.: US 6,931,754 B2
(45) Date of Patent: Aug. 23, 2005

(54) FREEZE-DRYING APPARATUS

(75) Inventors: Bernd Sennhenn, Worms (DE); Dietrich Gehrmann, Leverkusen (DE); Ariane Firus, Pulheim (DE)

(73) Assignee: Bayer Aktiengesellschaft, Leverkusen (DE)

( * ) Notice: Subject to any disclaimer, the term of this patent is extended or adjusted under 35 U.S.C. 154(b) by 43 days.

(21) Appl. No.: 10/411,006

(22) Filed: Apr. 10, 2003

(65) Prior Publication Data

US 2004/0060191 A1 Apr. 1, 2004

(30) Foreign Application Priority Data

Apr. 23, 2002 (DE) ..... 102 18 007

(51) Int. Cl.[7] ..... F26B 21/06
(52) U.S. Cl. ..... 34/75; 34/62; 34/92
(58) Field of Search ..... 34/287, 289, 92, 34/60, 62, 73, 75

(56) References Cited

U.S. PATENT DOCUMENTS

| | | | | |
|---|---|---|---|---|
| 3,048,928 A | | 8/1962 | Copson et al. | |
| 3,311,991 A | | 4/1967 | Gidlow | |
| 3,716,382 A | * | 2/1973 | Chandrasekaren et al. | 34/287 |
| 4,597,188 A | * | 7/1986 | Trappler | 34/287 |
| 5,131,168 A | * | 7/1992 | Rilke et al. | 34/284 |
| 5,398,426 A | | 3/1995 | Connor | 34/289 |
| 6,163,979 A | | 12/2000 | Oetjen et al. | 34/286 |

FOREIGN PATENT DOCUMENTS

| | | | |
|---|---|---|---|
| EP | 1 279 913 | 1/2003 | F26B/5/06 |
| FR | 2 695 329 | 3/1994 | B08B/3/02 |
| WO | WO 97/20181 | 6/1997 | F26B/5/06 |
| WO | WO 98/50744 | 11/1998 | F26B/5/06 |

OTHER PUBLICATIONS

Patent Abstracts of Japan, Application No. 63324889, Date: Dec. 23, 1988 Inventor: Ariyama Koichi.
Patent Abstracts of Japan, Application No. 63279516, Date: Jul. 11, 1988 Inventor: Shishido Nobuyuki.
Patent Abstracts of Japan, Application No. 56172109, Date: Oct. 29, 1981 Inventor: Matsuzaka Masamitsu.

* cited by examiner

*Primary Examiner*—Denise L. Esquivel
*Assistant Examiner*—Kathryn S. O'Malley
(74) *Attorney, Agent, or Firm*—Norris McLaughlin & Marcus PA

(57) ABSTRACT

A drying unit for removing solvent from moist material, and a method for drying moist material with the drying unit. The unit comprises at least one drying chamber (23) having at least one stand plate (2) for holding vessels (3), which are filled with moist material, or flat layers of moist material, the drying chamber (23) being connected to a condenser (22) via a vapor passage (15), in which sublimed solvent can be separated out, the stand plates (2) being connected to a temperature-controlled heating/cooling circuit, the chamber (23) having heating/cooling plates (4) or (4') which are connected to a second heat-transfer circuit, wherein the heating/cooling plates (4) or (4') are substantially thermally isolated from the chamber wall (6).

16 Claims, 5 Drawing Sheets

FREEZE-DRYING APPARATUS

The invention relates to a freeze-drying chamber with coolable/heatable stand plates for a multiplicity of product-filled vessels or with coolable/heatable stand plates which can be occupied by layers of product, with special facilities which eliminate the harmful influences of temperature, which are dependent on the progress of drying, on the chamber-wall surfaces. Specific designs make it possible to avoid high energy losses by means of a special chamber-wall structure combined, at the same time, with a reduction in the mass of the temperature-controlled components.

BACKGROUND OF THE INVENTION

During the drying in known freeze-drying chambers with a multiplicity of stand plates for product-filled containers or planar product layers, the containers or product layers in the edge region of the stand plates exchange energy more intensively than the containers/product layers positioned in the center of the plates, on account of radiant heat exchange and natural convection in the gap between the wall of the chamber and the stack of stand plates. This non-uniformity of the energy distribution leads to a variation of freezing and drying kinetics between the containers or product layers at the edges and those in the center.

The avoidance of the non-uniformity could be achieved by eliminating the non-uniformity of the driving potential responsible for the lack of uniformity in energy distribution. The driving potential for the drying is the temperature difference between product-filled containers or product layers and their environment, which supplies the potential required for the freeze-drying to progress. In the edge region of the stand plates, this potential is greater than in the central region of the stand plates, since there is direct heat exchange between containers at the edge and the chamber wall as a result of radiation and convection. During the freezing process according to the prior art (at standard or slightly reduced pressure), the natural convection of the gas in the clear gap between the wall and the temperature-controlled stand plates has a particularly intensive action as a heat-transfer medium for the containers which are exposed to the convective flow. These additional heat fluxes decrease towards the center of the plate and thereby cause the non-uniformity in the freezing and drying of the containers or product layers distributed over the plate.

According to the prior art, freeze-dryers are either produced completely without temperature-control equipment for the chamber walls or with heating/cooling jackets which are applied directly to the supporting structure. On account of the body contact with the heavy bearing structure of the chamber, these heating/cooling jackets have the purpose of cooling the chamber from the sterilizing temperature to the temperature which is suitable for loading. Then, the cooling liquid is generally emptied from these heating/cooling surfaces, in order to reduce the mass. The cooling of the chamber wall to a temperature which eliminates the driving potential responsible for the problem is not possible with these designs.

U.S. Pat. No. 5,398,426 describes a freeze-dryer whose chamber walls can be cooled in order to eliminate the disruptive temperature differences by establishing identical temperatures at the chamber walls and the stand plates. This design has two drawbacks:

1. The additional cooling surfaces are integrated in the mechanical bearing structure of the dryer, which has to be sufficiently reinforced for it to be able to withstand evacuation. This has the drawback that large masses have to heated/cooled when the dryer is operating. Therefore, the thermal reaction of the dryer is inevitably slow.
2. The control described in U.S. Pat. No. 5,398,426, namely establishing uniform wall and stand surface temperatures, does not lead, in particular during the first drying stage, the sublimation drying, to the desired elimination of the driving potential which is responsible for the problem and therefore also does not lead to the elimination of non-uniformities, in particular during the sublimation drying.

The invention is therefore based on the following objects:

eliminating the non-uniformity between the edge region and center region of the stand plates, which during the freezing and drying of product-filled vessels leads to uneven temperature and drying profiles of the vessels;

a reduction in the mass of the dryer which has to be heated or cooled.

SUMMARY OF THE INVENTION

The non-uniformity is eliminated by using regulated heating/cooling plates which are arranged in such a way that there is no driving temperature gradient between the chamber wall and the vessels on the stand plates. The resulting uniformity of the freezing and drying process in all the vessels allows the uniformity of the product quality to be improved and the drying capacity to be increased considerably.

DETAILED DESCRIPTION

The driving potential which is responsible for the problem is eliminated by means of additional temperature-regulated heating/cooling surfaces which are introduced into the drying chamber. The arrangement of these heating/cooling surfaces may vary. Residual natural convection—as is produced for example between containers or product layers and stand surfaces—is minimized as early as during the freezing stage of the freeze-drying by an additional reduction in the pressure.

The invention relates to a drying unit for removing solvent from moist material, comprising at least one drying chamber having at least one stand plate for holding vessels, which are filled with moist material, or flat layers of moist material, the drying chamber being connected to a condenser via a vapor passage, in which the sublimed solvent can be separated out, the stand plates being connected to a temperature-regulated heating/cooling circuit, the chamber having heating/cooling plates which are connected to a second heat-transfer circuit, characterized in that the heating/cooling plates are designed to be substantially thermally isolated from the chamber wall.

The elimination of the non-uniformity is avoided by temperature controlled heating/cooling plates. These plates have a similar or identical construction as the stand plates (sometimes also called shelfs). In order to achieve temperature control, these plates may have a conduits system with a suited arrangement of the conduits supplied with a flow of temperature-regulated heat transfer fluid from a heating and cooling system.

A preferred drying unit is characterized in that the heating/cooling plates are arranged at a distance from the chamber wall, i.e., spaced away from the chamber wall.

Particularly preferably, the outer chamber wall is of pressure-resistant design, so that the freeze-drying chamber can be evacuated without deformation or fracture of the wall.

A drying unit in which the outer chamber wall has a thermal insulation, so that the energy loss from the system is minimized, is also preferred.

Furthermore, a drying unit in which the heating/cooling plates are spaced away from but connected in a vacuum-tight manner to the chamber wall, so that the effective result is a two-chamber system, is also preferred.

The heating/cooling surfaces are in particular mechanically connected, by means of spacers, to the inner side of the chamber wall, with which they form a planar gap which can be evacuated. In this arrangement, vacuum connections are provided in the chamber wall.

A drying unit characterized in that the space formed by the gap between the heating/cooling plates and the chamber wall can be set to the pressure level of the drying chamber by means of a vacuum system, for the purposes of pressure compensation, is also preferred.

The spacers are preferably made from a material of low thermal conductivity, in particular from stainless steel.

A preferred embodiment of the drying unit is characterized in that flexible metal connecting sheets between lateral heating/cooling plates and the chamber wall are designed to be sufficiently flexible to compensate for the temperature-related changes in length (i.e., thermal expansion/contraction) of the heating/cooling surfaces without damage to the connecting sheets.

In a further preferred embodiment of the drying unit, heating/cooling plates are suspended in the drying chamber parallel to the edges of the stand plates and at a distance from the stand plates, so that the suspended heating/cooling plates form a virtually continuous radiation cage around the stack of stand plates.

In a preferred further embodiment of the drying unit, the drying chamber can be evacuated as early as during the freezing operation, in order to reduce the influences of convection.

In a particular structural form, the chamber wall has an outer thermal insulation.

In a preferred drying unit, the devices for clean-in-place/sterilize-in-place (CIP/SIP) are arranged in such a way that all the surfaces can be cleaned.

A drying unit characterized in that the operation of the temperature-control systems for the heating/cooling plates can be set to maintain the appropriate temperature by sensor control, is preferred.

In a variant of the preferred drying unit, the temperature-control systems for the heating/cooling plates are regulated to the appropriate temperature predictively under the control of a computer program.

In a further preferred variant of the drying unit, the temperature-control systems for the heating/cooling plates are under the control of a hybrid system comprising sensor and computer and are set to the appropriate temperature.

The inventive arrangement of the heating/cooling plates produces identical mass ratios between heating/cooling plates and stand plates, and as a result approximately identical temperature/time profiles for walls and stand plates/vessels becomes possible.

The regulation of the heating/cooling plates is based on the following strategy: The problem can be reduced but not completely eliminated if the walls and the stand plates alone are maintained at the same temperature (as described in U.S. Pat. No. 5,398,426). Rather, during the freeze-drying the wall temperatures have to substantially follow the vial temperature (FIG. 3.6), in order to virtually completely eliminate the problems. This effect is achieved by eliminating the disruptive temperature difference between chamber wall and vessel/stand plates. During the first drying stage, the vessel and stand plates are not at the same temperature, and consequently a composite temperature formed from the vessel temperature and stand plate temperature has to be set for the wall temperature. This composite temperature is expediently determined with the aid of a simulation program based on a predetermined lyocycle (temperature-pressure-time cycle).

The solution to this object is achieved by fitting the above-described heating/cooling surfaces whose temperature can be controlled separately and which surround the stand plates on all four sides, so that a virtually continuous radiation cage is formed. Eliminating the temperature differences between heating/cooling plates and stand plates/vessel in addition prevents the formation of the disruptive free convection, together with its supply of heat to the vessels standing at the edge or to the product layer at the edge of the plates, in particular during the freezing step (in which the free convection is particularly strong at ambient pressure). By contrast, during the freeze drying at low system pressures, the free convection plays much less of a role.

The heating-cooling plate temperature can be controlled/regulated in accordance with the following strategies:

Sensor-controlled Regulation:

During the freezingstage, the temperature of the stand plates and heating/cooling plates are regulated in such a way that they follow the same temperature program. After the drying program has started, the heating/cooling plate temperature and the stand plate temperature follow different programs. The stand plate temperature is determined by the predetermined lyocycle, and the temperature/time program which is predetermined in the lyocycle is run and regulated. In the first drying stage, the temperature of the heating/cooling plates is set to the sublimation temperature of the frozen product, which is dependent on the chamber pressure and the solvent. This temperature can be initially calculated approximately on the basis of the characteristics of the substances. Measurements of the sublimation temperature in laboratory experiments can be used to correct this calculated temperature. The pressure-rise method can also be used for direct determination of the sublimation temperature, as described, for example, by G. W. Oetjen in "Gefriertrocknen", VCH Verlag, 1997.

The temperature of the heating/cooling plates has to be changed when the second drying stage begins. The beginning of the second drying stage can be detected by measuring the system pressure in the gas stream coming out of the freezing chamber using different pressure-measuring sensors, e.g.: an absolute-pressure measuring appliance and a conductivity sensor (e.g. a Pirani sensor) which is set to nitrogen. When, at the end of the first dryingstage, the stream of solvent vapor moves towards 0, both measured variables approach the same value, since the nitrogen content in the gas stream rises continuously, and therefore the measured value from the Pirani sensor moves ever closer to the absolute-pressure measured value. The temperature of the heating/cooling plates can now slowly be raised to the temperature of the stand plates, and as the drying continues, the stand-plate temperature can be tracked. The extent to which the stand-plate temperature is approached is determined, for example, as a function of the pressure difference between the two pressure indicators.

Predictive Control of the Heating/cooling Plates:

If drying profiles carried out under defined conditions at the product which is to be dried have been recorded in a laboratory experiment, and this drying profile has been used to determine all the freeze-drying properties/parameters with the aid of a simulation program, assuming that the freeze-drying properties of the freeze dryer are known, the drying profile of the product can be calculated in advance, and the values for the product temperature determined by the calculation program can be used as a guide variable for the heating/cooling plate temperatures. This method is illustrated in FIG. 3*b*.

Hybrid method: In this method, the product temperatures are determined from the measurements in the freeze-dryer (absolute pressure, pressure after conductivity sensor) and simulation calculations, and are used as guide variable for the heating/cooling plate temperature.

The invention also relates to a method for drying moist material using a drying unit according to the invention, comprising the steps of:

sterilizing, if appropriate hot-sterilizing, the chamber, including the unoccupied stand plates, loading the stand plates with moist material or vessels which contain moist material, closing the chamber opening and cooling the stand plates, simultaneously cooling the heating/cooling plates, then evacuating and passing through a temperature program for stepwise heating of the stand plates and simultaneously gradually matching the temperature of the heating/cooling plates to the temperature of the vessels or of the moist material, introducing sterile gas into the apparatus, setting the temperature of the stand plates and of the heating/cooling plates to the unloading temperature, if appropriate to ambient temperature, if appropriate closing the vessels and removing the vessels or the moist material.

BRIEF DESCRIPTION OF THE DRAWINGS

The novel freeze-drying apparatus is illustrated in the figures, purely diagram-matically, and explained in more detail, by way of example, below. In the drawings.

EXAMPLES

Figure 1:
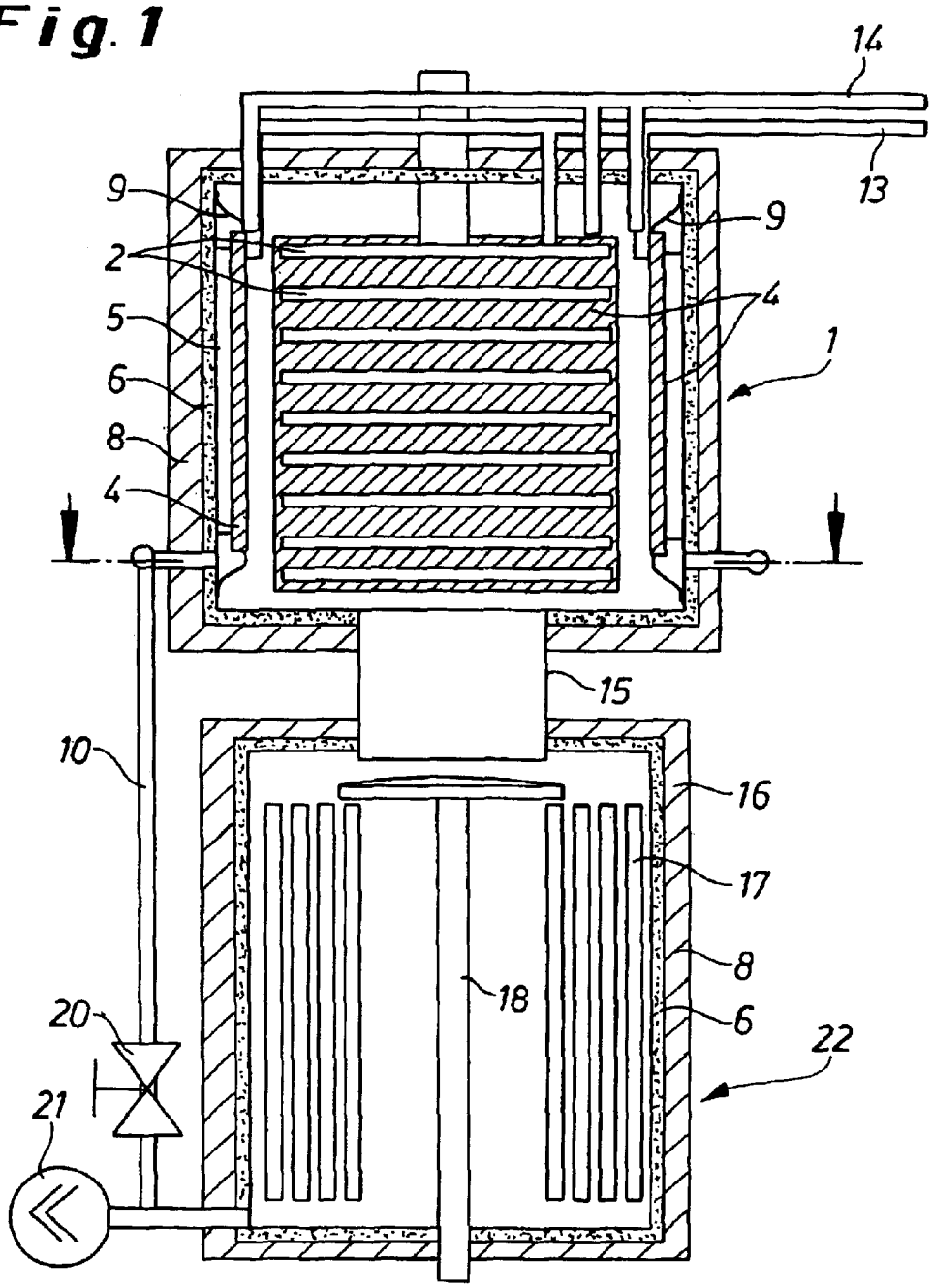
FIG. 1 shows the typical structure of a freeze-drying chamber according to the invention, with condenser, stand plates and wall-integrated heating/cooling plates, which are connected to a heating/cooling circuit which can be regulated separately, and the space between the mechanically rigid, heavy wall structure and the heating/cooling plates, which can be evacuated.
Figure 1A:
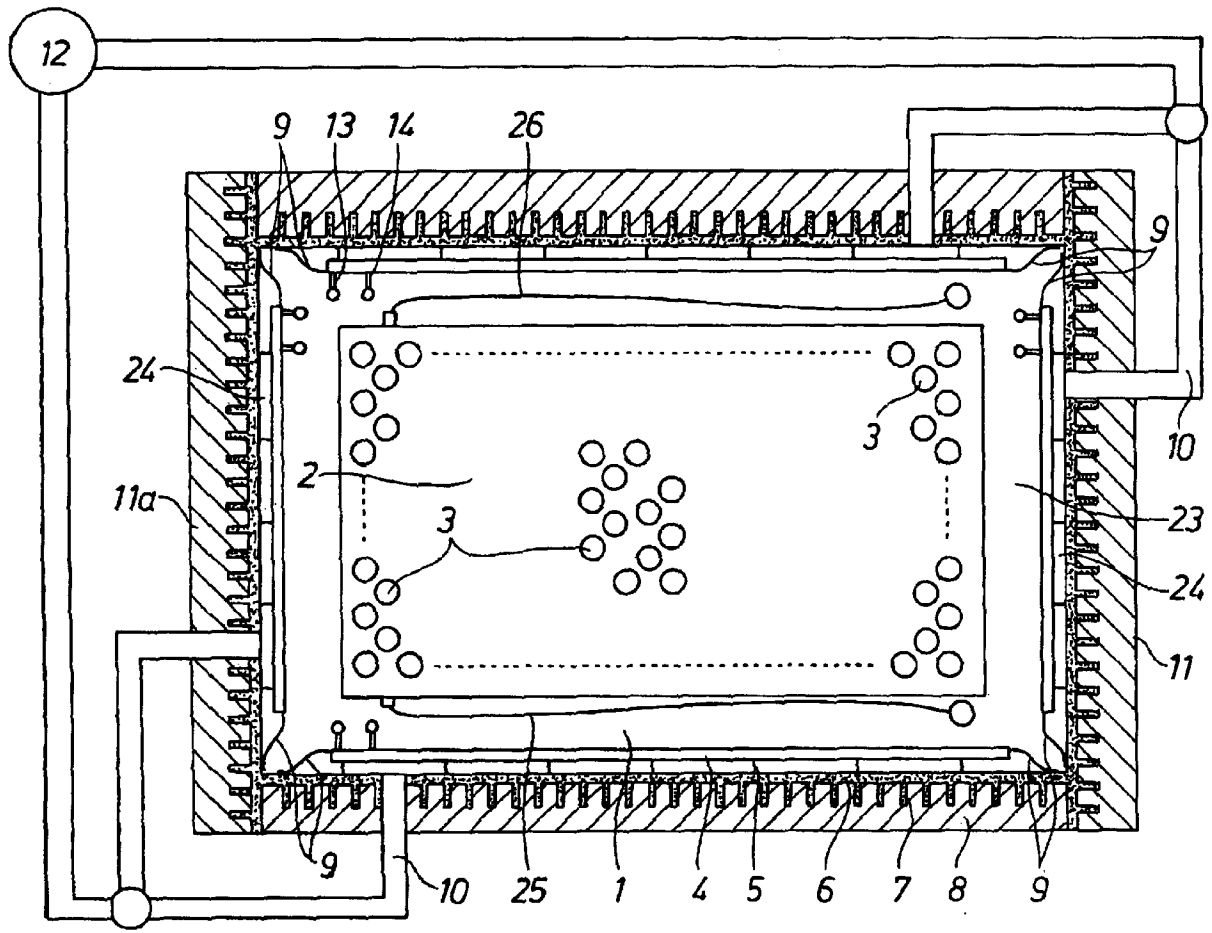
FIG. 1*a* shows a horizontal section through the freeze-drying chamber shown in FIG. 1, with wall-integrated heating/cooling plates.

FIG. 1 shows a system comprising freeze-drying chamber 1 and condenser chamber 22, in which drums of product-filled vessels are frozen and freeze-dried. FIG. 1*a* shows vessels 3 standing on the stand plate 2 in the edge region and in the central region. The chamber 1 has two doors 11, 11*a* which are sealed and can be opened separately. The freeze-drying chamber 1 has a two-shell structure. The heavy chamber-wall structure 6 with reinforcing ribs 7 has the task of providing a vacuum-tight, tortionally rigid housing, which is able to withstand the atmospheric pressure when the freeze-drying chamber 1 is evacuated, for the second, inner chamber 23 which is integrated therein. The chamber 1 is provided with thermally insulating material 8 on its outer side, to prevent heat exchange with the environment. The inner freeze-drying chamber 23 is formed from the heating/cooling plates 4, which are held at a distance from the chamber wall 6 with the aid of spacers 5 and are connected to the chamber wall 6 in a pressure-tight manner by means of flexible metal sheets 9, so that the space 24 between heating/cooling plates 4 and supporting wall 6 of the chamber 1 can be evacuated. The evacuation is effected via pipelines 10, 12 which are connected to the main vacuum pump 21 via valves 20. The evacuation of the space 24 serves two purposes: firstly, pressure compensation between freeze-drying chamber 23 and the space 24 between heating/cooling plates 4 and chamber wall 6, so that compressive forces acting on the heating/cooling plates 4 are avoided. Secondly, it serves to reduce the heat exchange as a result of the pressure-dependent reduction in the effective heat conduction of the space 24. During the drying phase, the same pressure prevails in the space 24 as in the freeze-drying chamber 23 ($p<0.1$ mbar), so that the space 24 acts in the same way as the evacuated gap of a Dewar flask. The spacers 5 between the heating/cooling plates 4 and the chamber wall 6 are made from a material with low thermal conductivity (e.g. stainless steel), and the number of spacers 5 is kept to the minimum required, so that the heat transfer caused by heat conduction through the spacers 5 is minimized.

The connecting metal sheets 9 are designed in such a way that the temperature-dependent change in length of the heating/cooling plates 4 (i.e., thermal expansion/contraction) can be absorbed by the metal sheets without any risk to the mechanical strength of the connection to the chamber wall 6. The result is the formation of a smooth-surface freeze-drying chamber 23 which can easily be cleaned. The heating/cooling plates 4 are supplied with heat-transfer liquid (silicone oil), which is supplied via the line 13 and discharged via the line 14, by means of a temperature-control system (not shown) which can be regulated separately. The temperature-control system uses the same heat-transfer medium as the stand plates and can be supplied from the same reservoir. The temperature-control system for the heating/cooling plates 4 fundamentally has to be operated at a temperature which is matched to the temperature of the vessels on the stand plates, while the heat-transfer medium for the stand plates 2 follows a different temperature program, which follows the lyocycle.

The temperature program for the heating/cooling plates 4 depends on the temperature of the vessels. This method has already been described in general terms above.

Example 2

Figure 2:
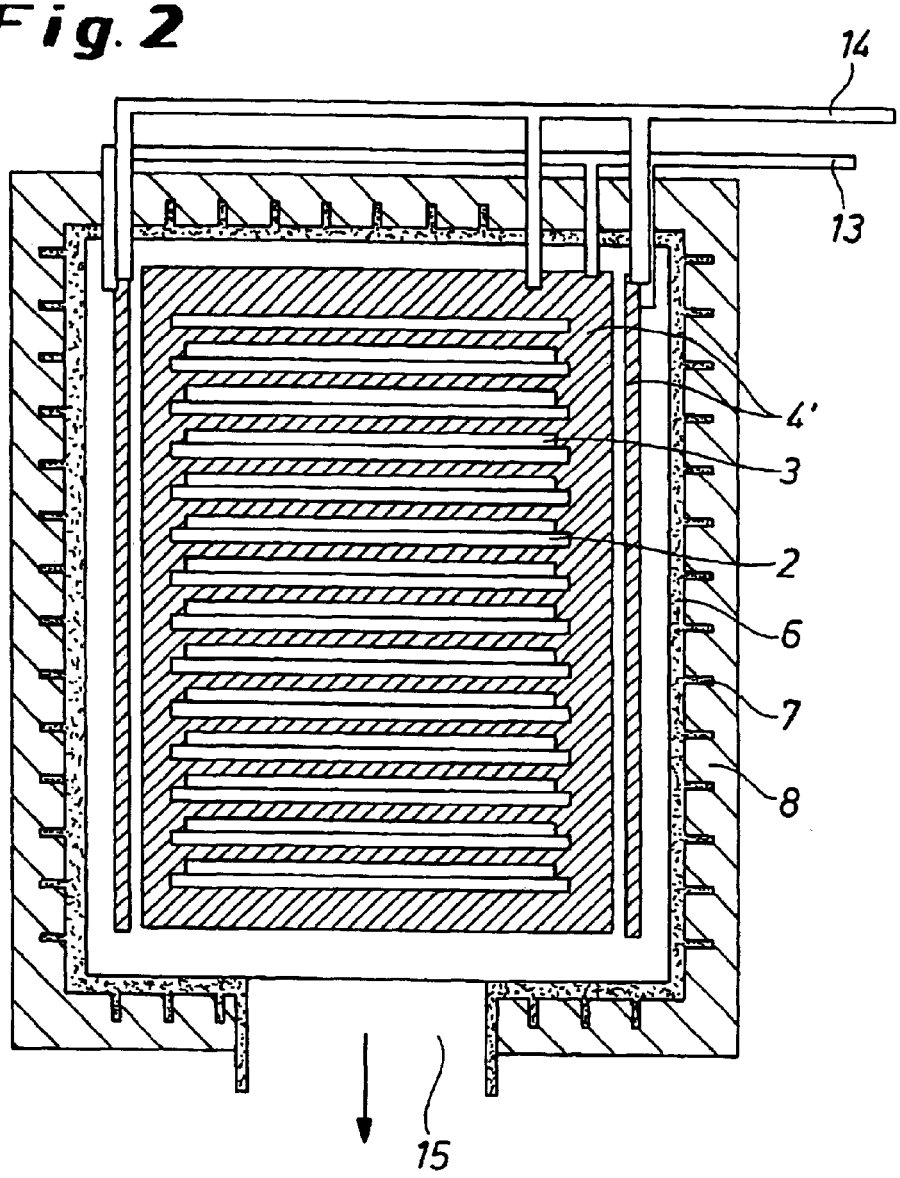
FIG. 2 shows a variant of the freeze-drying chamber according to the invention, with heating/cooling plates which are suspended vertically in front of the stand-plate stack and are connected to a heating/cooling circuit which can be regulated separately.

FIG. 2 shows an embodiment of the freeze-dryer which differs in terms of the way in which the heating/cooling plates 4' are arranged. In this case, the temperature-controlled plates 4' are suspended freely in the chamber 23. The heating/cooling plates 4' are suspended parallel to and at a distance from the edges of the standing plates 2, so that space is retained for all the equipment associated with the stand plates 2, for example hoses 25, 26 for the heat-transfer medium, stand-plate holders (not shown).

Known CIP/SIP features (automatic cleaning and sterilization systems) may additionally be provided in the interior of the chamber. The heating/cooling plates 4' are in turn fed with the heat-transfer medium from a separate heat-transfer circuit via inlet 13 and return 14. The mass of the heating/cooling plates in both embodiments (in accordance with Examples 1 and 2) corresponds to the mass of the stand plates 2, so that the heating/cooling dynamics of the plates 2 and 4 or 4' are also matched to one another and there are no shifts in the temperature caused by uneven masses.

Calculations Relating to the Temperature Curve:

Calculations have been carried out in connection with the temperature curve in a number of variants of the freeze-drying device, and these calculations are reproduced in the diagrams shown in FIG. 3*a* to 3*c* and 4.

Figure 3A:
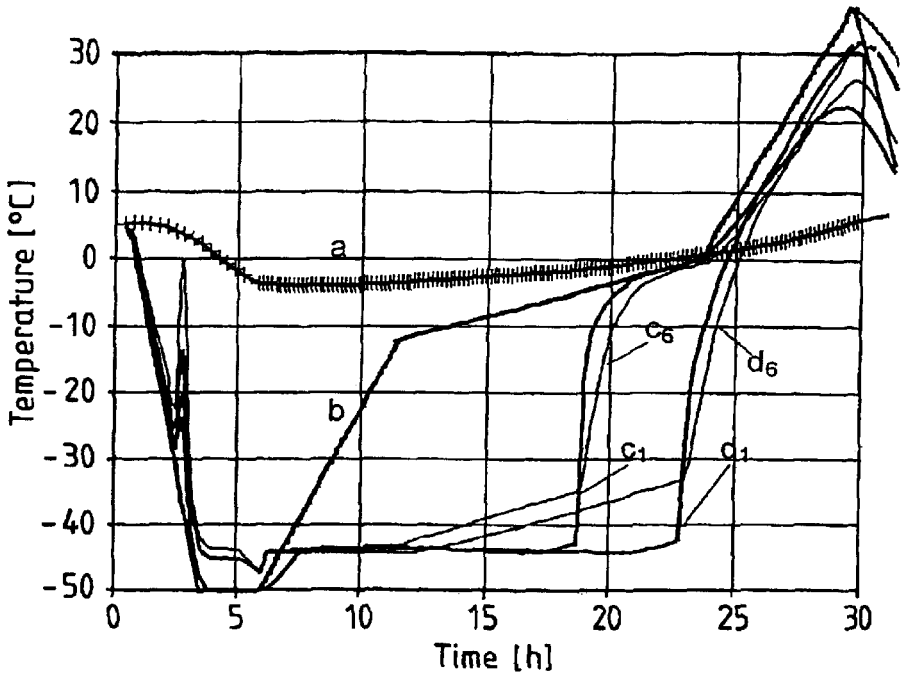
FIG. 3*a* shows the temperature curve of the vessels which are positioned at the edge and in the center of the stand plate with an unregulated wall temperature.
Figure 3B:
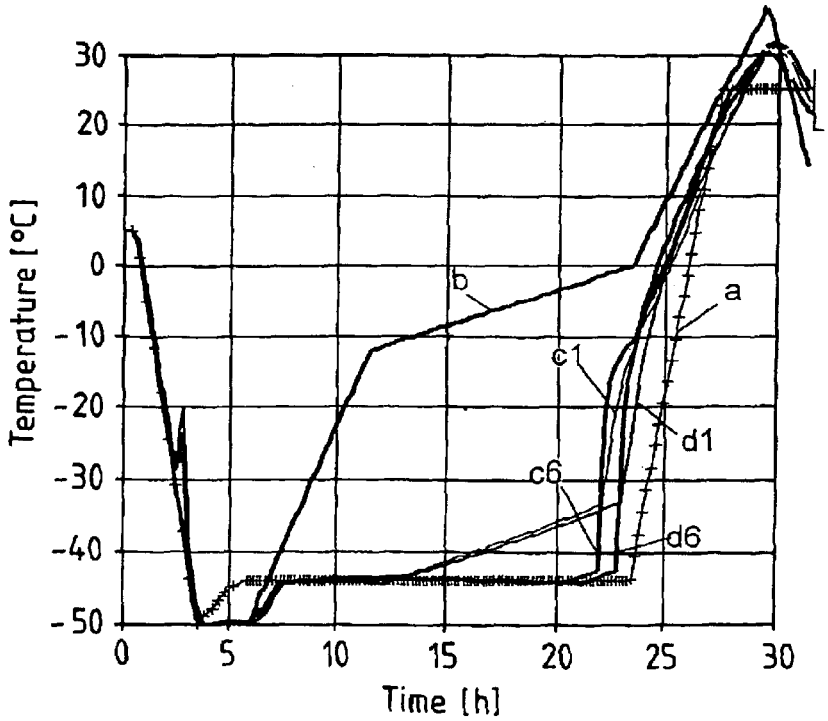
FIG. 3*b* shows the temperature curve of the vessels which are positioned at the edge of the plate and in the center of the stand plate with the wall temperature being regulated in accordance with the invention.

FIG. 3*a* shows the temperature curve of the vessels which are positioned at the edge and in the center of the stand plate, without the wall temperature being regulated. In this figure, the abbreviations have the following meanings:

| | |
|---|---|
| a | wall temperature (unregulated) |
| b | stand plate temperature |
| c | edge vessel temperature |
| d | center vessel temperature |

the indices 1 in this diagram and in those which follow represent the temperature at a cake height of 1 mm in the material being dried, and the indices 6 represent the temperature at a cake height of 6 mm in the material being dried;

FIG. 3*b* shows the temperature curve of the vessels which are positioned at the edge of the plate and in the center of the stand plate, with the wall temperature being regulated in accordance with the invention; in this figure, the meanings of the abbreviations are as follows:

| | |
|---|---|
| a | wall temperature (regulated) |
| b | stand plate temperature |
| c | edge vessel temperature |
| d | center vessel temperature; |

Figure 3C:
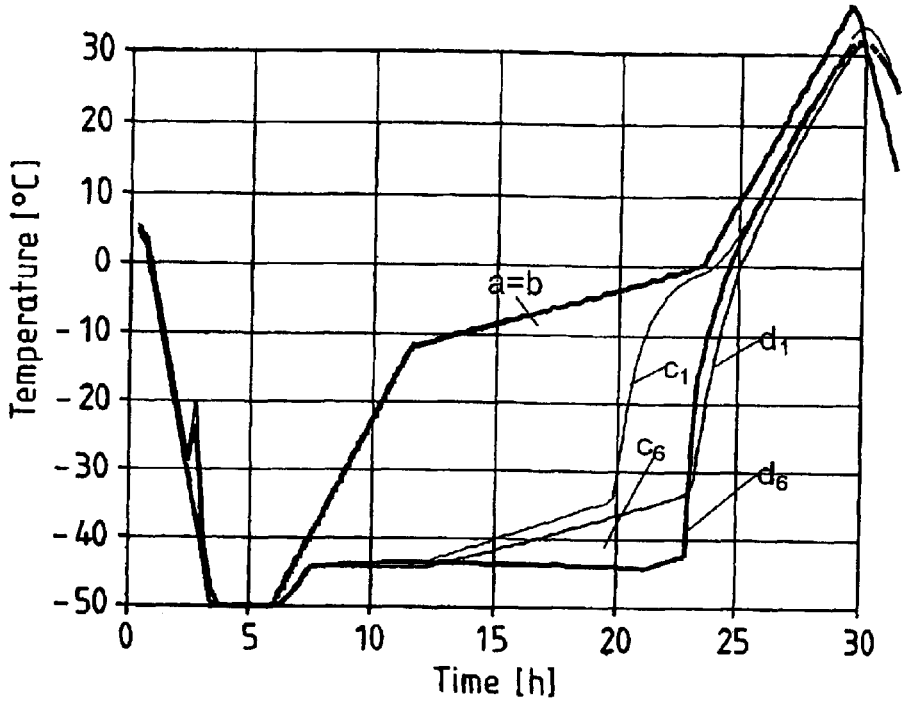
FIG. 3*c* shows the temperature curve of the vessels which are positioned at the edge of the plate and in the center of the stand plate when the wall temperature is regulated as described in U.S. Pat. No. 5,398,426.

FIG. 3*c* shows the temperature curve of the vessels which are positioned at the plate edge and in the center of the stand plate when the wall temperature is being regulated in accordance with U.S. Pat. No. 5,398,426; in this figure, the abbreviations have the following meanings:

| | |
|---|---|
| a | wall temperature (regulated) |
| b | stand plate temperature |
| c | edge vessel temperature |
| d | center vessel temperature. |

It immediately becomes clear from the diagrams that when the apparatus according to the invention with regulated wall temperature is used, the temperature characteristics of the vessels at the edges are substantially the same as the characteristics of the vessels arranged at the center of the stand plate (FIG. 3*b*), while when conventional facilities are in operation there are considerable differences in the temperature profile (FIG. 3*a*); the same is true when the wall temperature is regulated in accordance with U.S. Pat. No. 5,398,426 (FIG. 3*c*).

Figure 4:
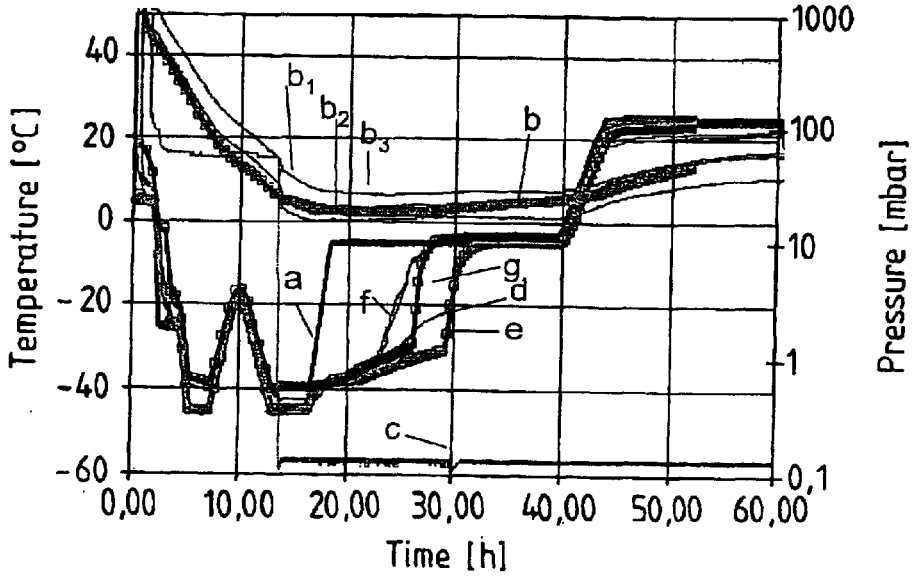
FIG. 4 shows calculations relating to the temperature curve for vessels 3 positioned at the edge and in the center of the stand plate 2.

FIG. 4 presents the data from an experiment carried out in a 1 $m^2$ pilot freeze-dryer (1 $m^2$ standing surface area). All the thin, continuous lines are measured values. The thick continuous lines are calculated values. The temperature curves for vessels 3 which are positioned at the edge of the plate and temperature curves for vessels 3 which were arranged in the center of the plate—well away from the wall and protected by the adjacent vessels—were compared. The calculated temperature curves distinguish between two situations:

for the vessels arranged in the center, no heat transfer through the radiating wall is taken into account, for the vessels positioned at the edge, all the heat exchange with the wall is taken into account.

The wall itself exchanges heat with the stand plates 2 and the environment and is therefore taken into account as a factor which varies over the course of time. The extent to which the calculated temperatures coincide with the measured temperatures can be considered satisfactory if the difficulties of measuring the temperature in the vessels is taken into account. It can be seen from this measurement and the evaluation by the simulation program that when the driving temperature potential between wall and stand plates 2 is eliminated, the vessels 3 located at the edges will also follow the temperature curve of the vessels in the center, as calculated for a different case in FIG. 3*b*. In FIG. 4, the abbreviations a to g have the following meanings:

| | |
|---|---|
| a | stand plate temperature |
| b | calculated wall temperature |
| $b_{1,2,3}$ | measured wall temperatures |
| c | chamber pressure (measured) |
| d | center vessel temperature (measured) |
| e | center vessel temperature (calculated) |
| f | edge vessel temperature (measured) |
| g | edge vessel temperature (calculated). |

What is claimed is:

1. Drying unit (1) for removing solvent from moist material, comprising at least one drying chamber (23) having a chamber wall (6), at least one stand plate (2) for holding vessels (3), which are filled with moist material, or flat layers of moist material, the drying chamber (23) being connected to a condenser (22) via a vapor passage (15), the stand plates (2) being connected to a temperature-regulated heating/cooling circuit, the chamber (23) having heating/cooling plates (4 or 4') which are connected to a second heat-transfer circuit, wherein the heating/cooling plates (4 or 4') are spaced away from the chamber wall (6), and are connected to the chamber wall (6) by vacuum-tight connectors and form vacuum chambers between themselves and said wall.

2. Drying unit according to claim 1, wherein the chamber wall (6) is sufficiently pressure-resistant to enable the chamber to be evacuated without deformation or fracture of said wall.

3. Drying unit according to claim 1, wherein the chamber wall (6) is provided with thermal insulation.

4. Drying unit according to claim 1, wherein the heating/cooling plates (4; 4') are mechanically connected by spaces (5) to the inner side of the chamber wall (6), with which they form planar gaps which defines said vacuum chambers, which can be evacuated, vacuum connections being provided though the chamber wall (6).

5. Drying unit according to claim 1 or 4, further comprising a vacuum system, wherein the pressure within the vacuum chambers is adjustable to the pressure level of the drying chamber by said vacuum system.

6. Drying unit according to claim 4, wherein the spacing (5) have a low thermal conductivity.

7. Drying unit according to claim 6, wherein said spacers are stainless steel spacers.

8. Drying unit according to claim 1, comprising flexible metal connecting sheets (9) between lateral heating/cooling plates (4; 4') and the chamber wall (6) which are sufficiently flexible to compensates for thermal expansion and contraction of the heating/cooling plates without damage.

9. Drying unit according to claim 1, wherein said at least one stand plate (2) is a stack of stand plates and heating/cooling plates (4') are suspended in the drying chamber (1) parallel to the edges of the stand plates (2) and are spaced away from the stand plates (2), to form a virtually continuous radiation cage around the stack of stand plates.

10. Drying unit according to claim 1, wherein the drying chamber (23) is adapted to be evacuated.

11. Drying unit according to claim 3, 9 or 10, wherein the chamber wall (6) is provided with an outer thermal insulation.

12. Drying unit according to claim 1, 9, or 10 further comprising cleaning-in-place/sterilization-in-place (CIP/SIP) cleaners disposed to clean all the surfaces of the drying unit.

13. Drying unit according to claim 1, wherein the heating/cooling plates are temperature controlled, and the temperature-control systems for the heating/cooling plates incorporate sensor control.

14. Drying unit according to claim 1, wherein the heating/cooling plates are temperature controlled, and the temperature control systems for the heating/cooling plates incorporate a predictive computer control program.

15. Drying unit according to claim 1, wherein the heating/cooling plates are temperature controlled, and the temperature control systems for the heating/cooling plates incorporate a hybrid control system comprising sensor and computer.

16. Method for drying moist material using the drying unit (1) of claim 1, comprising the steps of:

sterilizing, optionally by hot-sterilizing, the chamber (23), including the stand plates (2), loading the stand plates (2) with moist material or vessels (3) which contain moist material, closing the chamber and cooling the stand plates (2), simultaneously cooling the heating/cooling plates (4; 4'), then evacuating and carrying out a temperature program for stepwise heating of the stand plates (2) and simultaneously gradually matching the temperature of the heating/cooling plates (4; 4') to the temperature of the vessels (3) or of the moist material, introducing sterile gas into the drying chamber, setting the temperature of the stand plates (2) and of the heating/cooling plates (4; 4') to a desired unloading temperature, optionally to ambient temperature, optionally closing the vessels (3), and removing the vessels (3) or the moist material.

* * * * *

UNITED STATES PATENT AND TRADEMARK OFFICE

CERTIFICATE OF CORRECTION

PATENT NO. : 6,931,754 B2
DATED : August 23, 2005
INVENTOR(S) : Sennhenn et al.

It is certified that error appears in the above-identified patent and that said Letters Patent is hereby corrected as shown below:

Column 2,
Lines 1-2, “have to heated/cooled” should read -- have to be heated/cooled --.

Column 4,
Line 29, “the freezingstage” should read -- the freezing stage --.
Line 56, “first dryingstage” should read -- first drying stage --.

Column 8,
Line 67, “connected by spaces” should read -- connected by spacers --.

Column 9,
Line 9, “the spacing” should read -- the spacers --.
Line 16, “to compensates” should read -- to compensate --.

Signed and Sealed this

Twenty-eighth Day of March, 2006

JON W. DUDAS
*Director of the United States Patent and Trademark Office*